US008300870B2

(12) United States Patent
Lee et al.

(10) Patent No.: US 8,300,870 B2
(45) Date of Patent: Oct. 30, 2012

(54) VARIABLE DIRECTIONAL MICROPHONE ASSEMBLY AND METHOD OF MAKING THE MICROPHONE ASSEMBLY

(75) Inventors: Dong-Sun Lee, Bucheon (KR); Hyoung-Joo Kim, Incheon (KR)

(73) Assignee: BSE Co., Ltd., Incheon (KR)

( * ) Notice: Subject to any disclaimer, the term of this patent is extended or adjusted under 35 U.S.C. 154(b) by 0 days.

(21) Appl. No.: 12/663,296

(22) PCT Filed: Aug. 29, 2008

(86) PCT No.: PCT/KR2008/005090

§ 371 (c)(1), (2), (4) Date: Dec. 7, 2009

(87) PCT Pub. No.: WO2010/005142

PCT Pub. Date: Jan. 14, 2010

(65) Prior Publication Data

US 2011/0096951 A1 Apr. 28, 2011

(30) Foreign Application Priority Data

Jul. 11, 2008 (KR) ..... 10-2008-0067712

(51) Int. Cl.
*H04R 1/20* (2006.01)

(52) U.S. Cl. ..... 381/352; 381/355

(58) Field of Classification Search ..... 381/358, 381/357, 361, 365, 173, 92, 352, 355
See application file for complete search history.

(56) References Cited

U.S. PATENT DOCUMENTS

| | | | | |
|---|---|---|---|---|
| 2003/0068059 | A1 * | 4/2003 | Blok et al. | 381/361 |
| 2007/0263895 | A1 * | 11/2007 | Himori et al. | 381/365 |
| 2008/0013770 | A1 * | 1/2008 | Wu et al. | 381/357 |
| 2008/0037768 | A1 * | 2/2008 | Hsu et al. | 379/429 |
| 2008/0075313 | A1 * | 3/2008 | Lan et al. | 381/357 |
| 2008/0144874 | A1 * | 6/2008 | Wu et al. | 381/355 |
| 2009/0052686 | A1 * | 2/2009 | Wu et al. | 381/92 |
| 2009/0052699 | A1 * | 2/2009 | Andersen | 381/173 |

* cited by examiner

*Primary Examiner* — Yuwen Pan
*Assistant Examiner* — Phan Le
(74) *Attorney, Agent, or Firm* — Ladas & Parry LLP

(57) ABSTRACT

A variable directional microphone assembly and method of manufacturing the variable directional microphone assembly which includes a substrate, a semiconductor integrated circuit device, two microphone devices, a microphone body, and a case.

6 Claims, 7 Drawing Sheets

VARIABLE DIRECTIONAL MICROPHONE ASSEMBLY AND METHOD OF MAKING THE MICROPHONE ASSEMBLY

TECHNICAL FIELD

The present invention relates to a variable directional microphone, and more particularly, to a variable directional microphone assembly and a method of manufacturing the variable directional microphone assembly, which achieve miniaturization and improve sound quality, by mounting microphone devices provided to printed circuit board parts for microphone-mounting and connected with a flexible printed circuit board (FPCB), in a compact structure with a microphone body.

BACKGROUND ART

Microphones are generally classified into a non-directional (whole directions) microphone and a directional microphone according to directional characteristics. Such directional microphones are classified into a bi-directional microphone and a uni-directional microphone. The bi-directional microphone exhibits faithful reproduction characteristics for front and rear incident sounds, but exhibits reduction characteristics for a lateral incident sound. Thus, a polar pattern of the bi-directional microphone for a sound source describes a figure eight. Also, the bi-directional microphone has favorable near field characteristics, which is widely used for announcers in noisy stadiums. The uni-directional microphone maintains an output value in response to a wide front incident sound, but reduces an output value of a rear incident sound source, to improve a S/N ratio for a front sound source, which has a good articulation to be widely applied to voice-recognition equipment.

While the directional microphones obtain directional characteristics by respectively forming sound holes in a case and a PCB surface and using a phase difference between a front sound and a rear sound through a single microphone, variable directional microphones, having variable directional characteristics through two non-directional microphones, have been developed.

In manufacturing a variable directional microphone assembly with two non-directional microphones, according to a related art, two non-directional microphone devices and a semiconductor integrated circuit device are directly mounted to a rigid printed circuit board (commonly referred to as a ??PCB??), so that mechanical configuration for supplementing sound characteristics are unsatisfactory. Thus, sound quality is poor, and miniaturization is difficult.

DISCLOSURE

Technical Problem

The present invention has been made in an effort to solve the above-described limitations of the related art. An object of the present invention is to provide a variable directional microphone assembly and a method of manufacturing the same, which can achieve miniaturization and improve sound quality, by disposing microphone devices and a semiconductor integrated circuit device in a compact structure with a microphone body and by bending a FPCB to connect a signal.

Technical Solution

To achieve these objects and other advantages and in accordance with the purpose of the invention, as embodied and broadly described herein, there is provided a variable directional microphone assembly including: a substrate including printed circuit board parts for microphone-mounting respectively connected to both sides of a rigid printed circuit board part through connections of a bendable flexible printed circuit board; a semiconductor integrated circuit device installed to the rigid printed circuit board part of the substrate; two microphone devices respectively installed to the printed circuit board parts for microphone-mounting; a microphone body including a first mounting space for mounting the semiconductor integrated circuit device and two second mounting spaces for mounting the microphone devices, the first mounting space being provided to a surface of the microphone body, the second mounting spaces being provided to another surface of the microphone body, the semiconductor integrated circuit device being inserted into the first mounting space, the microphone devices being respectively inserted in the second mounting spaces with the bent connections; and a case configured to complete an assembly by receiving the microphone body having the microphone devices and the semiconductor integrated circuit device and by curling the case. The variable directional microphone assembly may further include cushions respectively attached to the microphone devices, and a dust-prevention fabric attached to an outer surface of the case including the sound hole.

The microphone body may include an injection-molded part formed of one of polycarbonate (PC) and thermoplastic elastomer (TPE), and the semiconductor integrated circuit device may include one of a digital signal processor (DSP) and an analog signal processor (ASP).

According to another aspect of the present invention, there is provided a method of manufacturing a variable directional microphone assembly, the method including: preparing a substrate including printed circuit board parts for microphone-mounting connected to both sides of a rigid printed circuit board part through connections of a flexible printed circuit board; mounting a semiconductor integrated circuit device to a surface of the rigid printed circuit board part; mounting microphone devices to the printed circuit board parts for microphone-mounting; cutting abridge of the substrate; coupling a microphone body and the substrate to each other by inserting the semiconductor integrated circuit device of the rigid printed circuit board part into a mounting space of the microphone body; bending the connections connecting the printed circuit board parts for microphone-mounting to the rigid printed circuit board part to respectively mount the microphone devices to microphone-mounting spaces of the microphone body; mounting the microphone body to a case and then curling ends of the case to complete an assembly; and attaching a dust-prevention fabric, for preventing ingress of dust and moisture, to a surface including a sound hole of the completely assembled case.

ADVANTAGEOUS EFFECTS

The variable directional microphone according to the present invention can achieve miniaturization and improve sound quality according to the formation of acoustic space, by mounting the microphone devices in a compact structure with the substrate having the flexible printed circuit board and the rigid printed circuit board part, and the microphone body having the mounting space for the semiconductor integrated circuit device and the mounting spaces for the microphone devices.

DESCRIPTION OF THE SYMBOLS IN MAIN PORTIONS OF THE DRAWINGS

BEST MODE

Preferred embodiments of the present invention will be described below in more detail with reference to the accompanying drawings. The present invention may, however, be embodied in different forms and should not be constructed as limited to the embodiments set forth herein.

Figure 1:
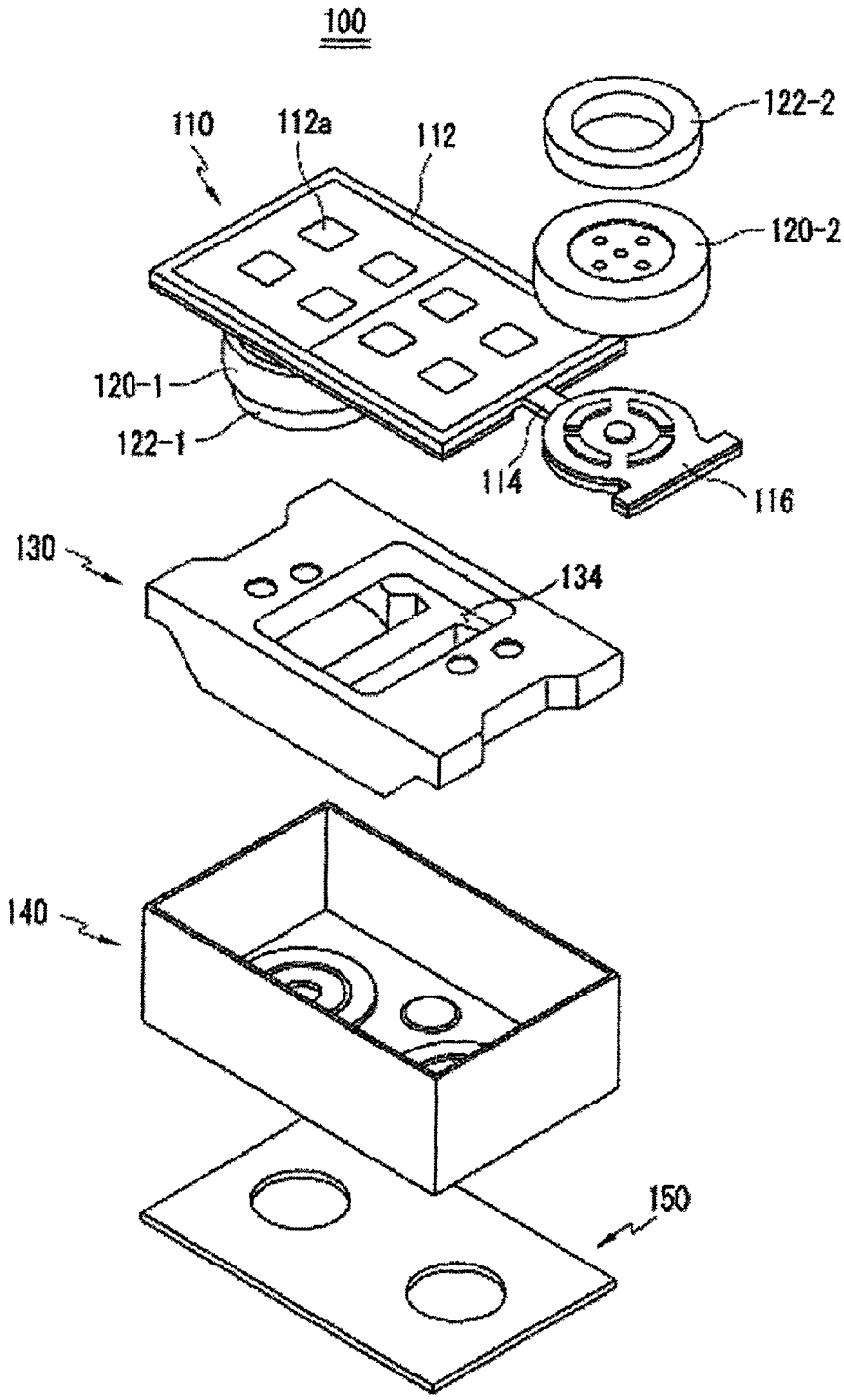
FIG. 1 is an exploded perspective view illustrating a top side of a variable directional microphone assembly according to an embodiment of the present invention.
Figure 2:
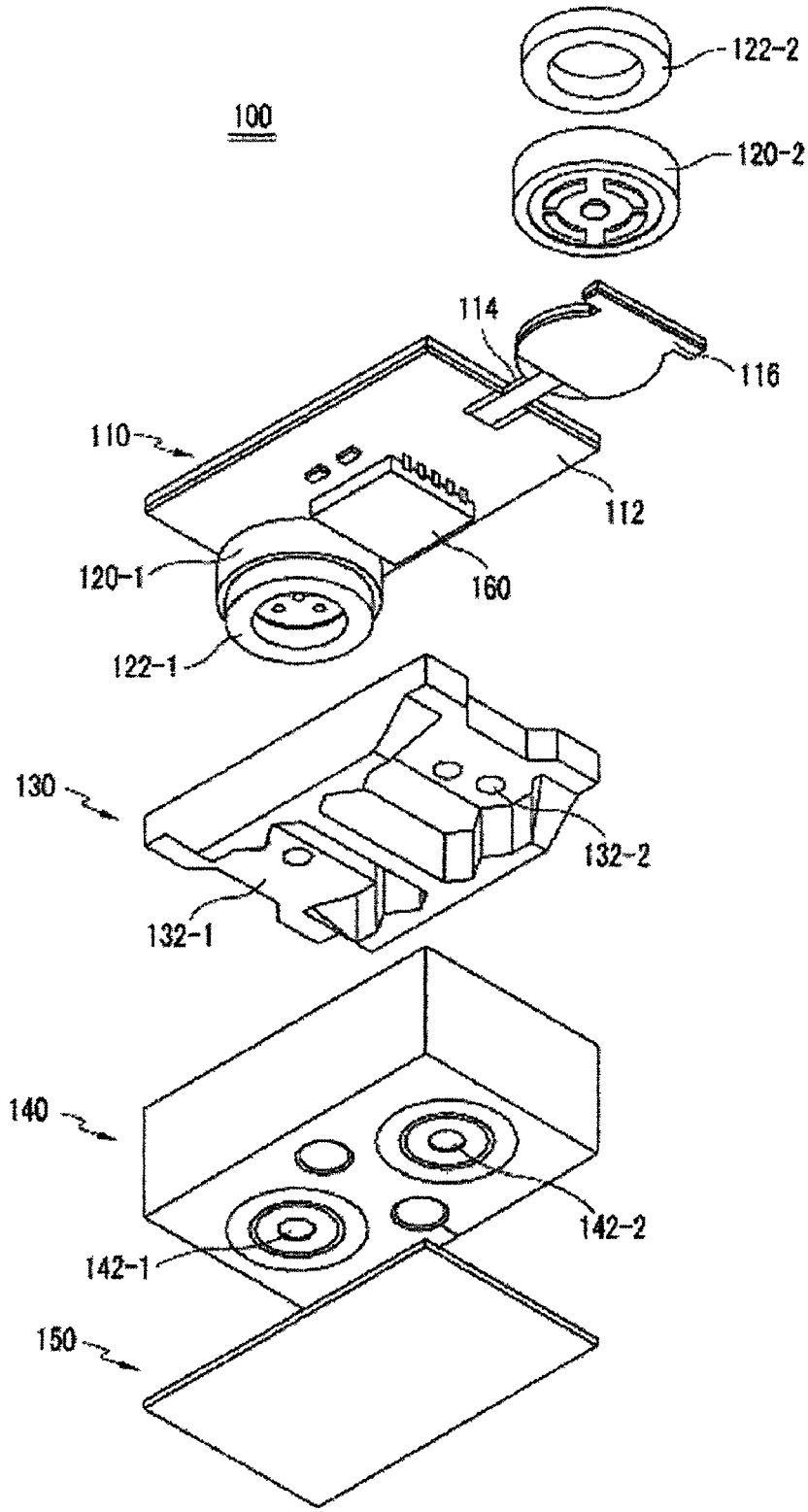
FIG. 2 is an exploded perspective view illustrating a bottom side of a variable directional microphone assembly according to an embodiment of the present invention.
Figure 3:
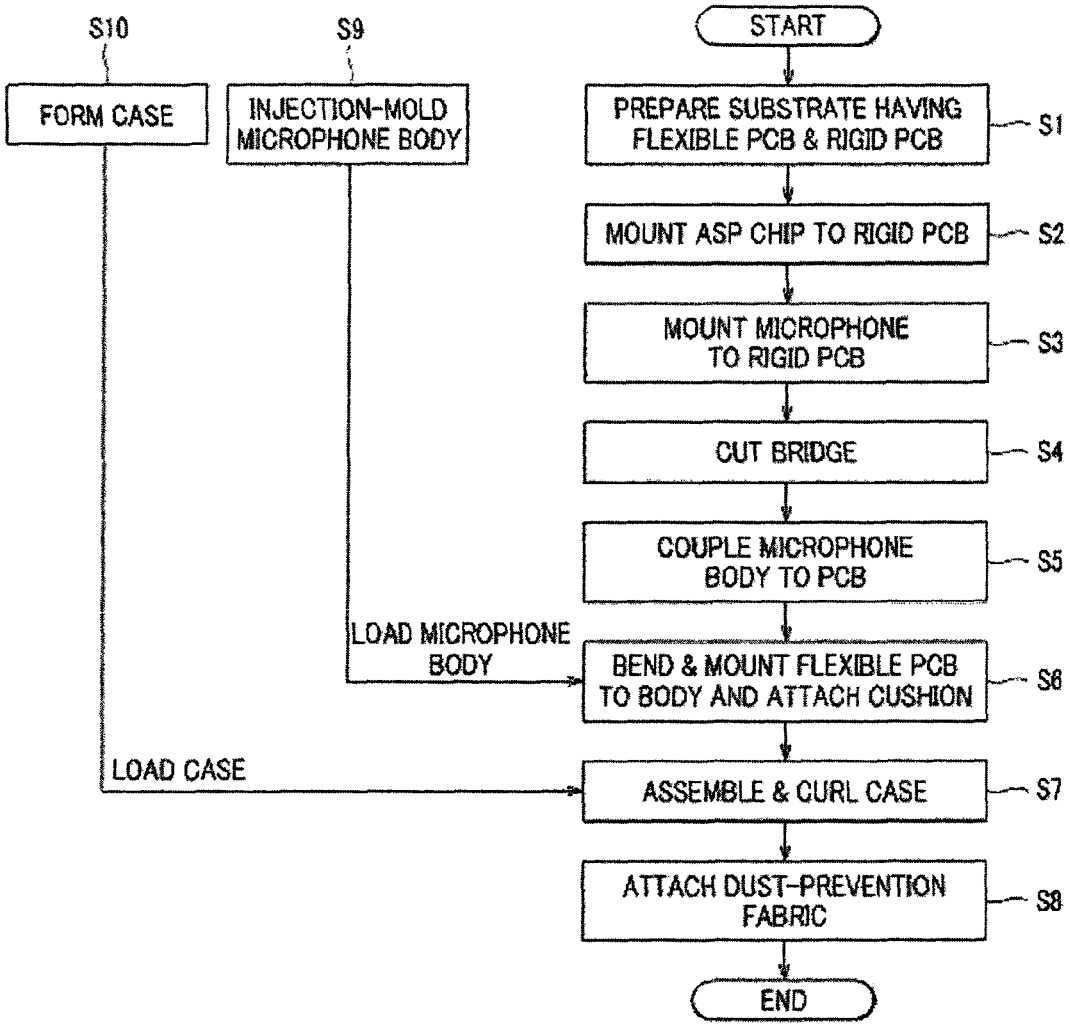
FIG. 3 is a flowchart illustrating a method of manufacturing a variable directional microphone assembly according to an embodiment of the present invention.

FIG. 1 is an exploded perspective view illustrating a top side of a variable directional microphone assembly 100 according to an embodiment of the present invention. FIG. 2 is an exploded perspective view illustrating a bottom side of the variable directional microphone assembly 100 according to the embodiment of the present invention. FIG. 3 is a flowchart illustrating a method of manufacturing the variable directional microphone assembly 100 according to the embodiment of the present invention.

Referring to FIGS. 1 and 2, the variable directional microphone assembly 100 includes a substrate 110, a semiconductor integrated circuit device 160, first and second microphone devices 120-1 and 120-2, cushions 122-1 and 122-2, a microphone body 130, a case 140, and a dust-prevention fabric 150. The substrate 110 includes printed circuit board parts 116, a rigid printed circuit board part 112, and connections 114. The printed circuit board parts 116 for microphone-mounting are respectively connected to the connections 114 of a bendable flexible printed circuit board, on both sides of the rigid printed circuit board part 112. The semiconductor integrated circuit device 160 is installed to the rigid printed circuit board part 112 of the substrate 110. The microphone devices 120-1 and 120-2 are installed to the printed circuit board parts 116, respectively. The cushions 122-1 and 122-2 are configured to protect the microphone devices 120-1 and 120-2. A mounting space 134 for mounting the semiconductor integrated circuit device 160 is provided to a surface of the microphone body 130, and two mounting spaces 132-1 and 132-2 for mounting the microphone devices 120-1 and 120-2 are provided to another surface of the microphone body 130. The case 140 is configured to fix an assembly by bending the connect ions 114, inserting the microphone body 130 coupled with the microphone devices 120-1 and 120-2 and the semiconductor integrated circuit device 160, and then performing a curling operation. The dust-prevention fabric 150 is attached to an outer bottom of the case 140.

Referring to FIGS. 1 and 2, the substrate 110 includes the rigid printed circuit board part 112 and the printed circuit board parts 116 for microphone-mounting connected through the connections 114 on the both sides of the rigid printed circuit board part 112. A surface of the rigid printed circuit board part 112 is provided with connection terminals 112*a* for connecting signals to the outside, and the semiconductor integrated circuit device 160 is mounted to another surface thereof. The semiconductor integrated circuit device 160 appropriately delays or integrates signals input from the two microphone devices 120-1 and 120-2 to generate a desired directional sound signal. The circular plate-shaped printed circuit board parts 116, to which the microphone devices 120-1 and 120-2 are mounted, are provided with a pattern for connection to microphones and connected to the rigid printed circuit board part 112 through the bendable connections 114. The microphone devices 120-1 and 120-2 are mounted to the respective printed circuit board parts 116 using a surface mounting technology (SMT), and then the cushions 122-1 and 122-2 formed of polyurethane foam are attached with an adhesive. The microphone body 130 is an injection-molded part formed of polycarbonate (PC) or thermoplastic elastomer (TPE), and a center of one surface thereof is provided with the mounting space 134 for mounting the semiconductor integrated circuit device 160, and another surface thereof is provided with the mounting spaces 132-1 and 132-2 for mounting the microphone devices 120-1 and 120-2. As such, according to the present invention, the microphones are mechanically fixed through the microphone body 130 provided with the mounting spaces 132-1 and 132-2 for the microphones, thereby achieving a compact structure and obtaining favorable sound quality characteristics according to acoustic space.

The case 140 has a rectangular container-shape with an open side, and a bottom thereof is provided with first and second sound holes 142-1 and 142-2 for introducing sound into the two microphone devices 120-1 and 120-2. After mounting parts including the microphone body 130 and the substrate 110 having the microphone devices 120-1 and 120-2, ends 140*a* of the case 140 are curled to complete the assembly.

The first and second microphone devices 120-1 and 120-2, mounted to the printed circuit board parts 116, are non-directional condenser microphones converting vibrations of an acoustic pressure introduced from the outside into electrical signals. The semiconductor integrated circuit device 160, mounted to the rigid printed circuit board part 112, is a digital signal processor (DSP) or an analog signal processor (ASP), which processes electrical sound signals transmitted from the first and second microphone devices 120-1 and 120-2 to generate variable directional electrical sound signals.

Referring to FIG. 3, the method of manufacturing the variable directional microphone assembly 100 will now be described. In operation S1, the substrate 110 is prepared, which includes the printed circuit board parts 116 for microphone-mounting connected to the connections 114 on the both sides of the rigid printed circuit board part 112. In operation S2, the semiconductor integrated circuit device 160 is mounted to one surface of the rigid printed circuit board part 112. In operation S3, the microphone devices 120-1 and 120-2 are mounted to the printed circuit board parts 116. In operation S4, a bridge of the substrate 110 is cut. In operation S5, the microphone body 130 and the substrate 110 are coupled to each other. In operation S6, the connections 114 are bent, and the microphone devices 120-1 and 120-2 are mounted to the mounting spaces 132-1 and 132-2, and the cushions 122-1 and 122-2 are attached. In operation S7, the microphone body 130 is mounted to the case 140, and then the ends 140*a* of the case 140 are curled to complete the assembly. In operation S8, the dust-prevention fabric 150, for preventing the ingress of dust and moisture, is attached to the bottom of the case 140 including the sound holes 142-1 and 142-2.

Figure 4:
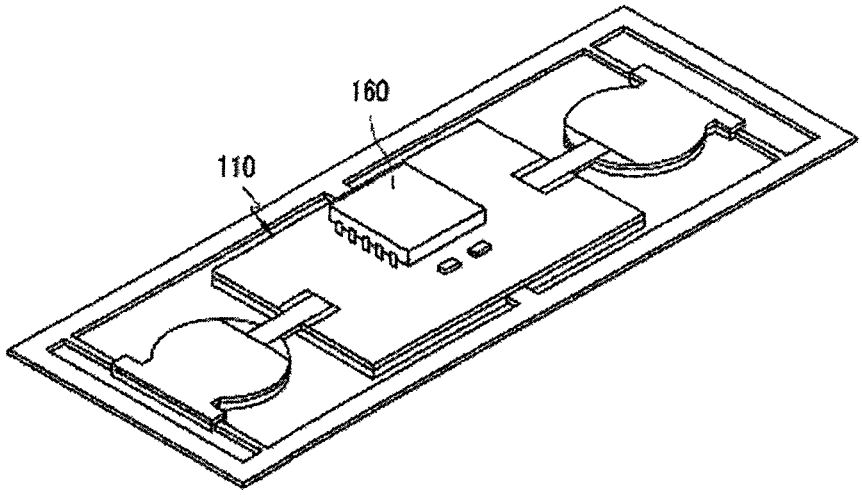
FIGS. 4 through 9 are views illustrating a manufacturing process according to an embodiment of the present invention.
Figure 5:
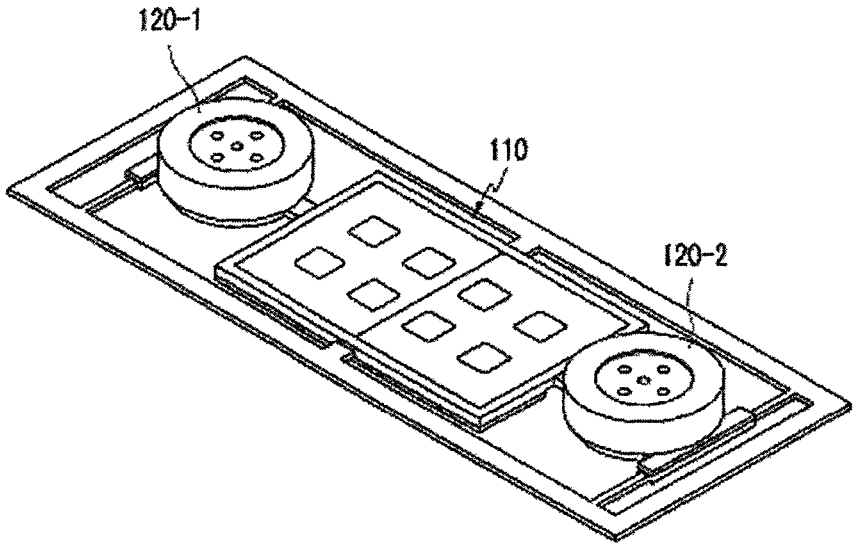
Figure 6:
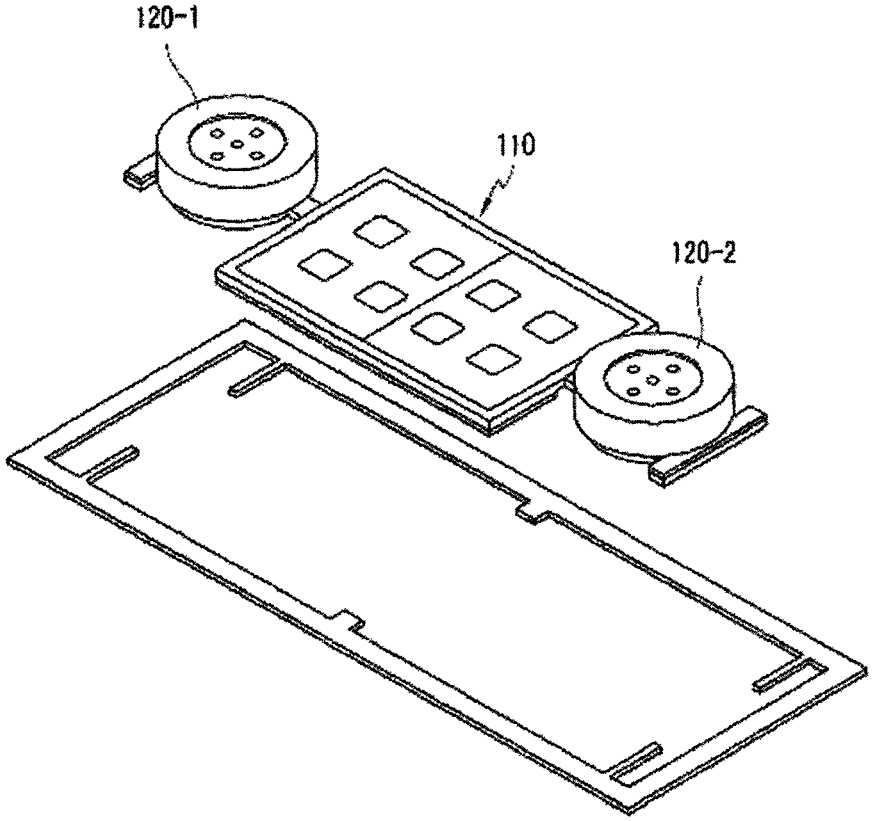
Figure 7:
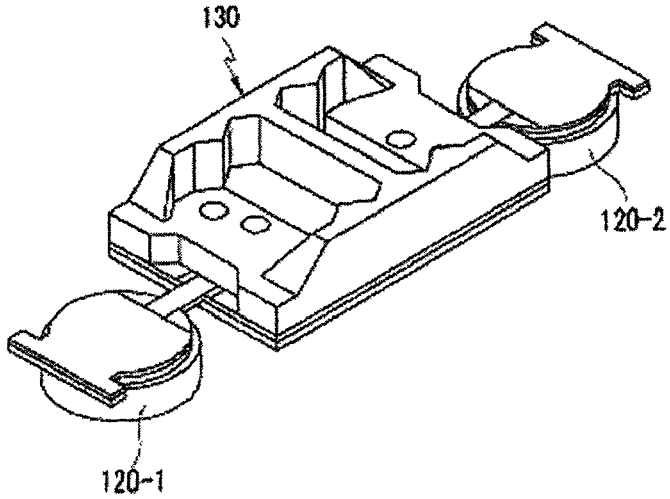
Figure 8:
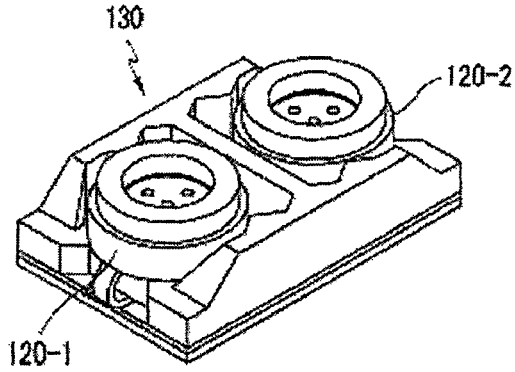
Figure 9:
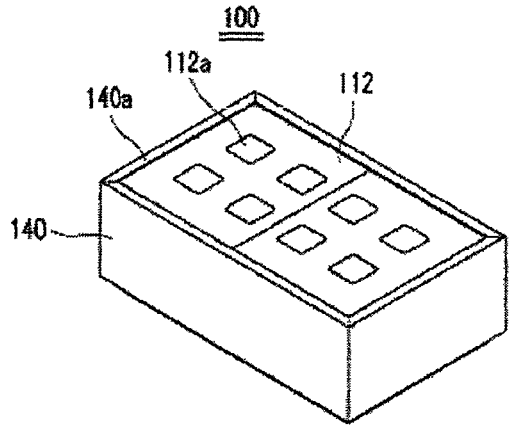

Referring to FIG. 3, in operation S1, the substrate 110 is prepared, connected to a frame with the bridge to prevent droop of the printed circuit board parts 116 connected to the connections 114 during the operations. In operation S2, the semiconductor integrated circuit device 160 is mounted to one surface of the rigid printed circuit board part 112 using the SMT, as illustrated in FIG. 4. In operation S3, as illustrated in FIG. 5, the substrate 110 is turned over, and the microphone devices 120-1 and 120-2 are, using the SMT, mounted to the opposite surface of the printed circuit board parts 116 to the surface to which the semiconductor integrated circuit device 160 is mounted. Then, in operation S4, as illustrated in FIG. 6, the bridge is cut, and the frame is removed. In operation S5, the microphone body 130 injection-molded in operation S9 is loaded, and then the substrate 110 having the microphone devices 120-1 and 120-2 and the semiconductor integrated circuit device 160 is coupled to the microphone body 130 as illustrated in FIG. 7. In operation S6, as illustrated in FIG. 8, the connections 114 are bent to respectively insert the microphone devices 120-1 and 120-2 into the mounting spaces 132-1 and 132-2 of the microphone body 130, and then the cushions 122-1 and 122-2 are attached to the microphone devices 120-1 and 120-2 with an adhesive, respectively. In operation S7, the assembled microphone body 130 is inserted into the case 140 formed in operation S10, and then the ends 140*a* are curled to complete the assembly. In operation S8, the dust-prevention fabric 150, for preventing dust from being introduced through the sound holes 142-1 and 142-2 into the microphone, is attached to the outer bottom of the assembled case 140.

Figure 10:
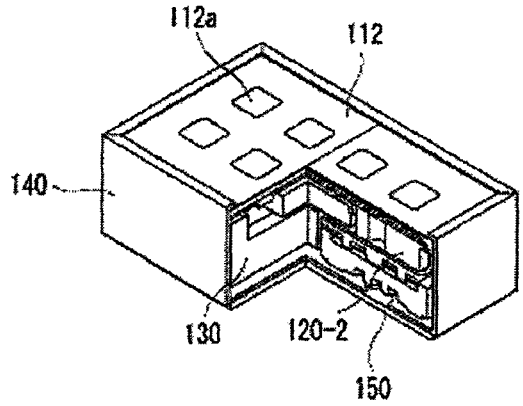
FIG. 10 is a cut-away perspective view illustrating a variable directional microphone according to an embodiment of the present invention.
Figure 11:
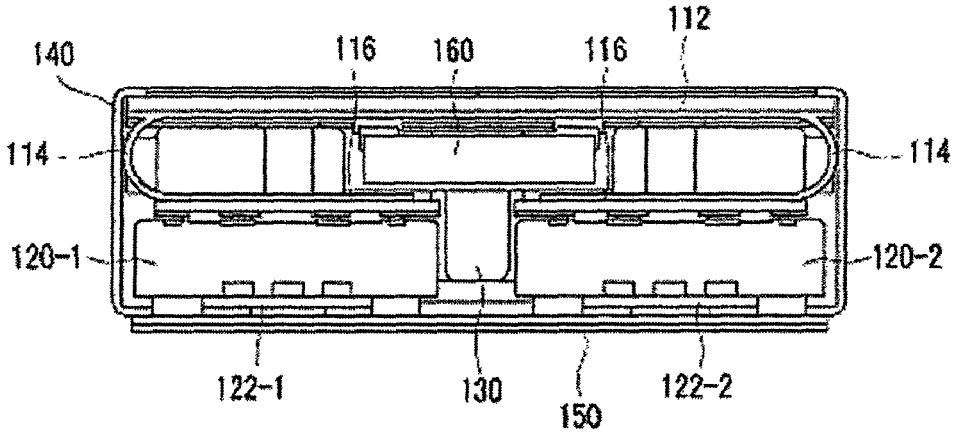
FIG. 11 is a cross-sectional view illustrating a variable directional microphone according to an embodiment of the present invention.

FIG. 10 is a cut-away perspective view illustrating the completed variable directional microphone according to the embodiment of the present invention. FIG. 11 is a cross-sectional view illustrating the completed variable directional microphone according to the embodiment of the present invention.

Referring to FIGS. 10 and 11, in the variable directional microphone assembly 100, the semiconductor integrated circuit device 160 is mounted to an inner side of the rectangular plate-shaped rigid printed circuit board part 112, and the printed circuit board parts 116 are connected to the both sides of the rigid printed circuit board part 112 through the connections 114, and the microphone devices 120-1 and 120-2 are mounted to the printed circuit board parts 116, and the semiconductor integrated circuit device 160 is inserted into the mounting space 134 of the microphone body 130, and the microphone devices 120-1 and 120-2 are respectively mounted to the mounting spaces 132-1 and 132-2 of the microphone body 130 to electrically connect to the rigid printed circuit board part 112 through the bent connections 114.

Also, the cushions 122-1 and 122-2, disposed between the microphone devices 120-1 and 120-2 and the case 140, serve as a buffer for them, and the dust-prevention fabric 150 is attached to the outer side of the case 140 to prevent a foreign object from being introduced into the microphone through the sound holes 142-1 and 142-2 of the case 140.

The variable directional microphone assembly 100 of the present invention is electrically connected to an electronic product (not shown) through the connection terminals 112*a* disposed on the outer side of the substrate 110. Thus, when power is supplied to the variable directional microphone assembly 100, the first microphone device 120-1 receives sound through the first sound hole 142-1 disposed in the case 140 to generate an electrical sound signal and transmit the generated signal to the semiconductor integrated circuit device 160 mounted to the rigid printed circuit board part 112, through the printed circuit board part 116 and the connection 114, and the second microphone device 120-2 also receives sound through the second sound hole 142-2 disposed in the case 140 to generate an electrical sound signal and transmit the generated signal to the semiconductor integrated circuit device 160 mounted to the rigid printed circuit board part 112 through the printed circuit board part 116 and the connection 114. The semiconductor integrated circuit device 160 processes the electrical sound signals transmitted from the first and second microphone devices 120-1 and 120-2 to generate variable directional electrical sound signals and transmit the variable directional electrical sound signals through the connection terminals 112*a* to the electronic product (e.g., a cellular phone). It will be apparent to those skilled in the art that various modifications and variations can be made in the present invention. Thus, it is intended that the present invention covers the modifications and variations of this invention provided they come within the scope of the appended claims and their equivalents.

The invention claimed is:

1. A variable directional microphone assembly comprising:

a substrate including printed circuit board parts for microphone-mounting respectively connected to both sides of a rigid printed circuit board part through connections of a bendable flexible printed circuit board;

a semiconductor integrated circuit device installed to the rigid printed circuit board part of the substrate;

two microphone devices respectively installed to the printed circuit board parts for microphone-mounting;

a microphone body including a first mounting space for mounting the semiconductor integrated circuit device and two second mounting spaces for mounting the microphone devices, the first mounting space being provided to a surface of the microphone body, the second mounting spaces being provided to another surface of the microphone body, the semiconductor integrated circuit device being inserted into the first mounting space, the microphone devices being respectively inserted in the second mounting spaces with the bent connections; and a case including a sound hole in a bottom thereof and fixing the substrate and the microphone body through curling, the sound hole corresponding to the microphone device.

2. The variable directional microphone assembly of claim 1, further comprising cushions respectively attached to the microphone devices, and a dust-prevention fabric attached to an outer surface of the case including the sound hole.

3. The variable directional microphone assembly of claim 2, wherein the microphone body comprises an injection-molded part formed of one of polycarbonate (PC) and thermoplastic elastomer (TPE) , and the semiconductor integrated circuit device comprises one of a digital signal processor (DSP) and an analog signal processor (ASP).

4. A method of manufacturing a variable directional microphone assembly, the method comprising:

preparing a substrate including printed circuit board parts for microphone-mounting connected to both sides of a rigid printed circuit board part through connections of a flexible printed circuit board;

mounting a semiconductor integrated circuit device to a surface of the rigid printed circuit board part;

mounting microphone devices to the printed circuit board parts for microphone-mounting;

cutting a bridge of the substrate;

coupling a microphone body and the substrate to each other by inserting the semiconductor integrated circuit device of the rigid printed circuit board part into a first mounting space of the microphone body;

bending the connect ions connecting the flexible printed circuit board to the rigid printed circuit board part to respectively mount the microphone devices to second mounting spaces of the microphone body; and mounting the microphone body to a case and then curling ends of the case to complete an assembly.

5. The method of claim 4, further comprising:

attaching a cushion to the microphone device; and attaching a dust-prevention fabric, for preventing ingress of dust and moisture, to a surface including a sound hole of the case.

6. A variable directional microphone assembly comprising:

a substrate comprising a rigid circuit board having a first surface, a second surface opposite the first surface, and side surfaces connecting the first and second surfaces; the substrate including printed circuit board parts for microphone-mounting, wherein the printed circuit board parts are connected to opposing side surfaces of the rigid printed circuit board part through connections of a bendable flexible printed circuit board;

a semiconductor integrated circuit device mounted on the first surface of the rigid printed circuit board part of the substrate;

two microphone devices respectively mounted on the printed circuit board parts for microphone-mounting;

a microphone body including a first mounting space formed within a first surface of the microphone body, and two second mounting spaces formed within a second surface of the microphone body that is opposite to and faces away from the first surface, the microphone body being positioned on the first surface of the rigid printed circuit board such that the semiconductor integrated circuit is mounted within the first mounting space, the printed circuit board parts being bent towards the two second mounting spaces such that the connections of the bendable flexible printed circuit board are bent and the two microphone devices are respectively fitted within the two second mounting spaces; and a case including a sound hole in a bottom thereof and in which the substrate and the microphone body are inserted, the sound hole corresponding to the microphone devices.

* * * * *